US008163170B2

(12) United States Patent
van Egmond et al.

(10) Patent No.: US 8,163,170 B2
(45) Date of Patent: Apr. 24, 2012

(54) COIL FOR PYROLYSIS HEATER AND METHOD OF CRACKING

(75) Inventors: Cor Franciscus van Egmond, Pasadena, TX (US); Kandasamy Meenakshi Sundaram, Old Bridge, NJ (US)

(73) Assignee: Lummus Technology Inc., Bloomfield, NJ (US)

( * ) Notice: Subject to any disclaimer, the term of this patent is extended or adjusted under 35 U.S.C. 154(b) by 651 days.

(21) Appl. No.: 12/315,296

(22) Filed: Dec. 2, 2008

(65) Prior Publication Data

US 2010/0133146 A1 Jun. 3, 2010

(51) Int. Cl.
*C10G 9/14* (2006.01)

(52) U.S. Cl. ..... 208/126; 208/106; 208/125; 208/132

(58) Field of Classification Search ..... 208/106, 208/125, 126, 132
See application file for complete search history.

(56) References Cited

U.S. PATENT DOCUMENTS

| | | | | |
|---|---|---|---|---|
| 3,167,066 | A | 1/1965 | Hughes | 126/350 |
| 3,725,495 | A * | 4/1973 | Wrisberg et al. | 585/414 |
| 3,872,179 | A * | 3/1975 | Andersen et al. | 585/651 |
| 4,111,793 | A * | 9/1978 | Kolombos et al. | 208/121 |
| 4,342,642 | A * | 8/1982 | Bauer et al. | 208/130 |
| 4,432,791 | A | 2/1984 | Jayaraman et al. | 75/65 R |
| 5,208,069 | A | 5/1993 | Clark et al. | 427/226 |
| 5,413,813 | A | 5/1995 | Cruse et al. | 427/237 |
| 5,616,754 | A | 4/1997 | Cruse et al. | 556/409 |
| 5,655,599 | A | 8/1997 | Kasprzyk | 165/133 |
| 5,866,745 | A * | 2/1999 | Gartside et al. | 585/653 |
| 6,419,885 | B1 | 7/2002 | Di Nicolantonio et al. | 422/198 |
| 6,923,900 | B2 | 8/2005 | Jones et al. | 205/654 |
| 7,049,477 | B2 * | 5/2006 | Chae et al. | 585/653 |
| 2006/0102327 | A1 | 5/2006 | Inui et al. | |

FOREIGN PATENT DOCUMENTS

| | | | |
|---|---|---|---|
| JP | 10-103624 | A | 4/1998 |
| JP | 2008-106174 | A | 5/2008 |
| KR | 20-1994-0016806 | U | 7/1994 |

OTHER PUBLICATIONS

Towfighi, et al., "Steam Cracking of Naphtha in Packed Bed Reactors" in Ind. Eng. Chem. Res., 2002, 41, 1419-1424.*

International Search Report and Written Opinion mailed Jun. 24, 2010 in corresponding PCT application No. PCT/US2009/064902 (7 pages).

* cited by examiner

*Primary Examiner* — In Suk Bullock
*Assistant Examiner* — Bradley Etherton
(74) *Attorney, Agent, or Firm* — Osha • Liang LLP

(57) ABSTRACT

Randomly packing with filler material at least part of a pass in a coil used in a system for pyrolyzing hydrocarbon feedstock to lighter hydrocarbons. Randomly packing increases heat transfer and decreases the rate of coke build-up within the coil, yielding an improvement in overall system efficiency. Packing material can comprise or be treated with a suitable catalyst for increasing the rate of chemical decomposition, thus further improving system efficiency.

10 Claims, 6 Drawing Sheets

COIL FOR PYROLYSIS HEATER AND METHOD OF CRACKING

BACKGROUND

The disclosed embodiments generally relate to pyrolysis coils, and more particularly to a packing and method of improving heat transfer in a pyrolysis coil.

It is known to use finned radiant tubes in a pyrolysis heater in order to promote mixing, gas turbulation, and increased surface area, thereby improving heat transfer. Finned tubes are disclosed in U.S. Pat. No. 6,419,885. No mention is made of a packing material in the finned tube.

It is known from U.S. Pat. No. 5,655,599 to fabricate tube fins from high temperature metal alloys, monolithic ceramics, metal matrix composites, or ceramic matrix composites. U.S. Pat. Nos. 5,413,813, 5,208,069 and 5,616,754 disclose ceramic coatings on pyrolysis coils to help reduce coke deposition. Further, U.S. Pat. No. 6,923,900 discloses finned tubes of various high carbon content alloy compositions and a method of making the tubes. Ceramic tubes are described for use in an aluminum melting system in U.S. Pat. No. 4,432,791. Techniques for radiant heating are described in U.S. Pat. No. 3,167,066.

It would be useful to provide a heating coil and method of heating in which heat transfer is improved in a pyrolysis cracking process.

SUMMARY

A coil for a pyrolysis heating system has an inlet where feedstock is introduced into the coil and an outlet where olefin product exists the coil, and at least one generally cylindrical pass between the inlet and outlet. At least part of at least one pass is randomly packed with a thermally conductive filler material.

A method of increasing heat transfer in a coil of a pyrolysis system with at least one generally cylindrical pass positioned between an inlet and an outlet, comprising randomly packing at least part of at least one pass with a thermally conductive filler material.

A method of pyrolyzing a hydrocarbon feedstock into olefins in a system having an enclosed furnace with at least one generally cylindrical coil, each coil with an inlet, an outlet and at least one pass, comprising randomly packing at least part of at least one coil pass with a thermally conductive filler material, introducing the hydrocarbon feed into the inlet of the coils, heating the coils to a temperature sufficient to break down the hydrocarbon feedstock into olefins, and collecting the olefins at the coil outlet.

DETAILED DESCRIPTION

Figure 1:
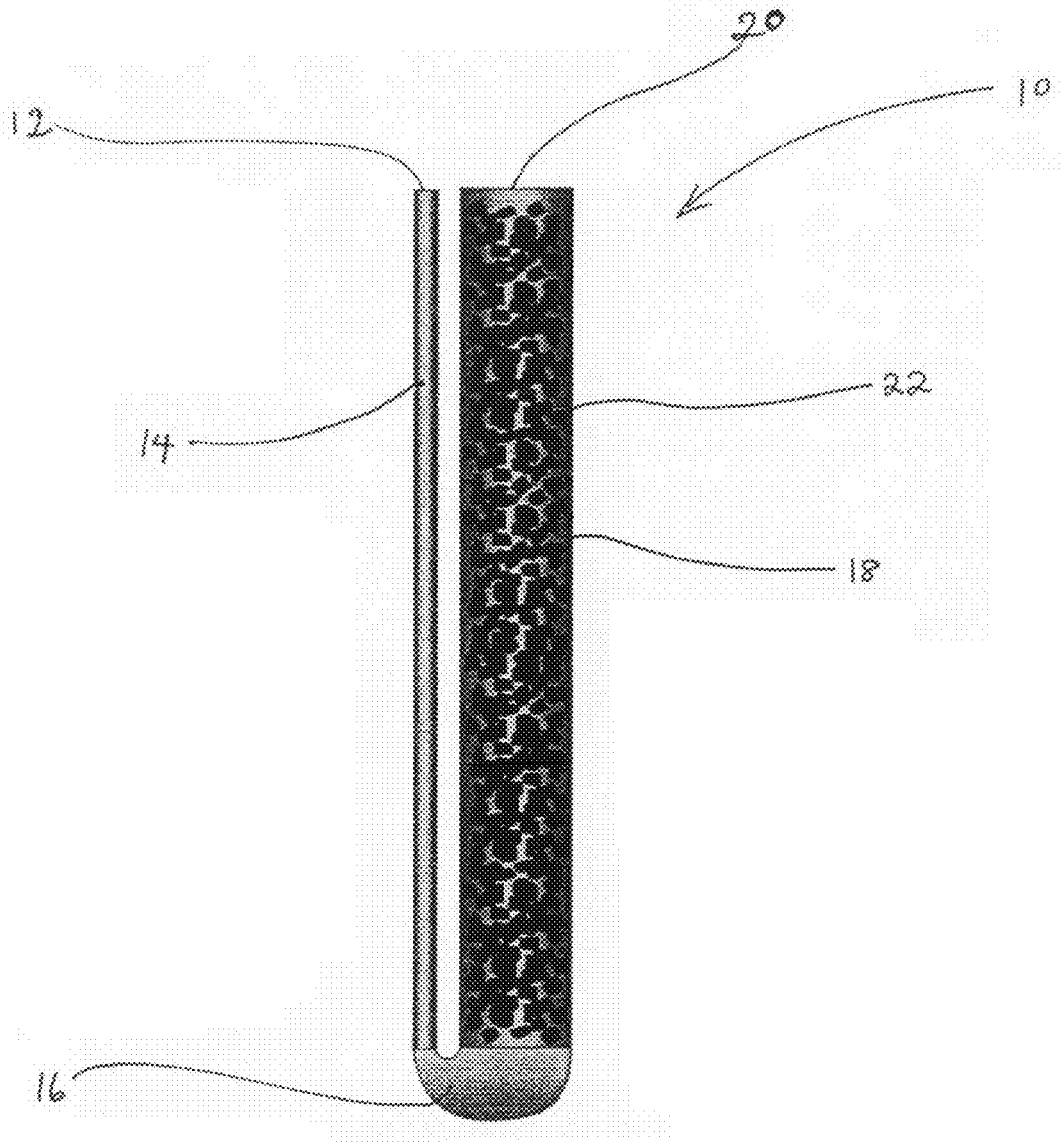
FIG. 1 shows a two-pass coil with random packing disposed within the second pass.

A heating coil for a pyrolysis heater is provided in which random packing is included in one or more passes. The incorporation of the packing enables the heating coil to operate at higher severities and/or longer run lengths than similar non-packed coils.

As used herein, the term "random packing" refers to a filler material for a heating coil that is randomly arranged. The term "void volume" is the volume within a coil that is not filled with random packing; i.e., in an unpacked coil, the "void volume" is the entire volume of the coil. The term "ceramic" as used herein refers to a non-metallic, heat-resistant material. The term "olefin" as used herein refers to a hydrocarbon containing at least one carbon-carbon double bond. The terms "pyrolysis" and "cracking" are used synonymously herein and refer to the chemical decomposition of organic compounds into simpler compounds. The term "coke" is a solid carbon byproduct that usually remains and oftentimes builds up on the walls of a heating coil during the pyrolysis process; the term "coke" can also refer to the process of producing the solid carbon residue byproduct. The term "decoking" refers to the shutdown of the pyrolysis heater for removal of coke buildup. The term "hydrocarbon feedstock" refers to a generally raw hydrocarbon material, possibly containing mixtures of hydrocarbons, that is fed into a pyrolysis system and processed into lighter hydrocarbons such as olefins. The term "selectivity" refers generally to the rate of production of desired product(s), and more particularly, "selectivity" is calculated as the number of moles of desired product produced per unit mole of feed converted. The term "pressure drop" refers generally to the pressure differential between two points, and more specifically, in pyrolysis, "pressure drop" is the pressure differential between a coil's inlet and outlet.

Generally, pyrolysis (cracking) is the chemical process by which more complex hydrocarbons in a feedstock are thermally decomposed into simpler, often unsaturated hydrocarbons (olefins), including, but not limited to ethylene and propylene. A common method of pyrolyzing hydrocarbon feedstock is by heating reactor coils in a furnace. Pyrolysis furnaces exist within which at least one generally cylindrical coil with an inlet and an outlet is positioned. Coils generally feature three sections: a convection section, where feedstock is preheated; a radiant section, where the preheated feedstock is decomposed; and a quench section where hot effluent from the radiant section is cooled. The coils can have one, two or multiple passes. In a method known as steam cracking, hydrocarbon feedstock is diluted with steam and fed through the coils within the furnace. The mixture is heated within the radiant section by the furnace to a predetermined temperature and quickly quenched at the coil outlet to prevent further decomposition.

As hydrocarbon feedstock is decomposed to olefin product, solid deposits of carbon byproduct (coke) slowly build up on the interior of the coils. Additionally, as olefin is produced, there is a net increase in the number of moles of gas. The combination of coke build-up and molar increase leads to a significant rise in pressure within the coil. The pressure increase reduces the selectivity and output of olefin. This is known as "selectivity loss."

Consequently, at a predetermined time or when a predetermined level of coke is present within a coil, the reactor must be shut down to decoke the coils. Decoking commonly requires passing an air and steam mixture through the coils instead of a hydrocarbon mixture feedstock. The air-steam mixture reacts with the solid carbon to form carbon monoxide and/or carbon dioxide gas that is released from the coils. As will be discussed in detail below, randomly packing one or more coils with certain materials yields not only an improved heat transfer coefficient, but can reduce the rate of coke deposition, and thus enable longer run lengths prior to shutdown for decoking. This improves the overall efficiency of the pyrolysis system.

During pyrolysis, coke precursors diffuse to the inner surface of the hot metal walls of the coil. The precursors undergo a dehydrogenation to form coke. Thus, coke production is a two-step process—diffusion and reaction. Regardless of which step controls the coke deposition rate, it is widely appreciated that, while the relationship is nonlinear, metal wall temperature is directly proportional to the coke deposition rate.

As illustrated in Examples to follow, randomly packing the coil in the manner disclosed herein substantially increases the heat transfer coefficient within the coils. It is understood in the art that the heat transfer coefficient in packed beds increases versus unpacked beds chiefly due to enhanced mixing within the packed bed. In the cases of pyrolysis coils, such an increase in heat transfer coefficient yields a more rapid rise in temperature inside the coil and reduces the maximum wall temperature. The more rapid rise in temperature accelerates the rate of cracking, and therefore increases the rate of olefin production. Further, packing material can be or contain some amount of a catalyst suitable for further increasing the rate of chemical decomposition. Simultaneously, the maximum wall temperature decrease reduces the rate of coking, thus enabling longer run lengths.

Referring to the drawings and first to FIG. 1, a two-pass pyrolysis heater coil is shown and is generally designated as 10. The coil includes an inlet 12, a thermal cracking zone 14, a U-shaped curve 16, and a second pass 18. Cracked product is removed through outlet 20.

In the embodiment of FIG. 1, random packing 22 is disposed in the second pass 18. Preferably, the random packing comprises a non-metallic material in order to reduce coking (described in detail below). Non-limiting examples of suitable packing materials include ceramics and silica. Ceramics are even more preferable because of their high thermal conductivities. Non-limiting examples of suitable ceramics include silicon carbides, hexalloy and the like. As discussed below, the random packing material can comprise a plurality of individual pieces or particles of virtually any shape. It is understood that the particles in a randomly packed bed generally does not shift or move within the coil as the gaseous mixture passes through. This is unlike a fluidized bed, wherein gaseous mixtures or liquids mix with finer solid particles and behave as a fluid.

Figure 2:
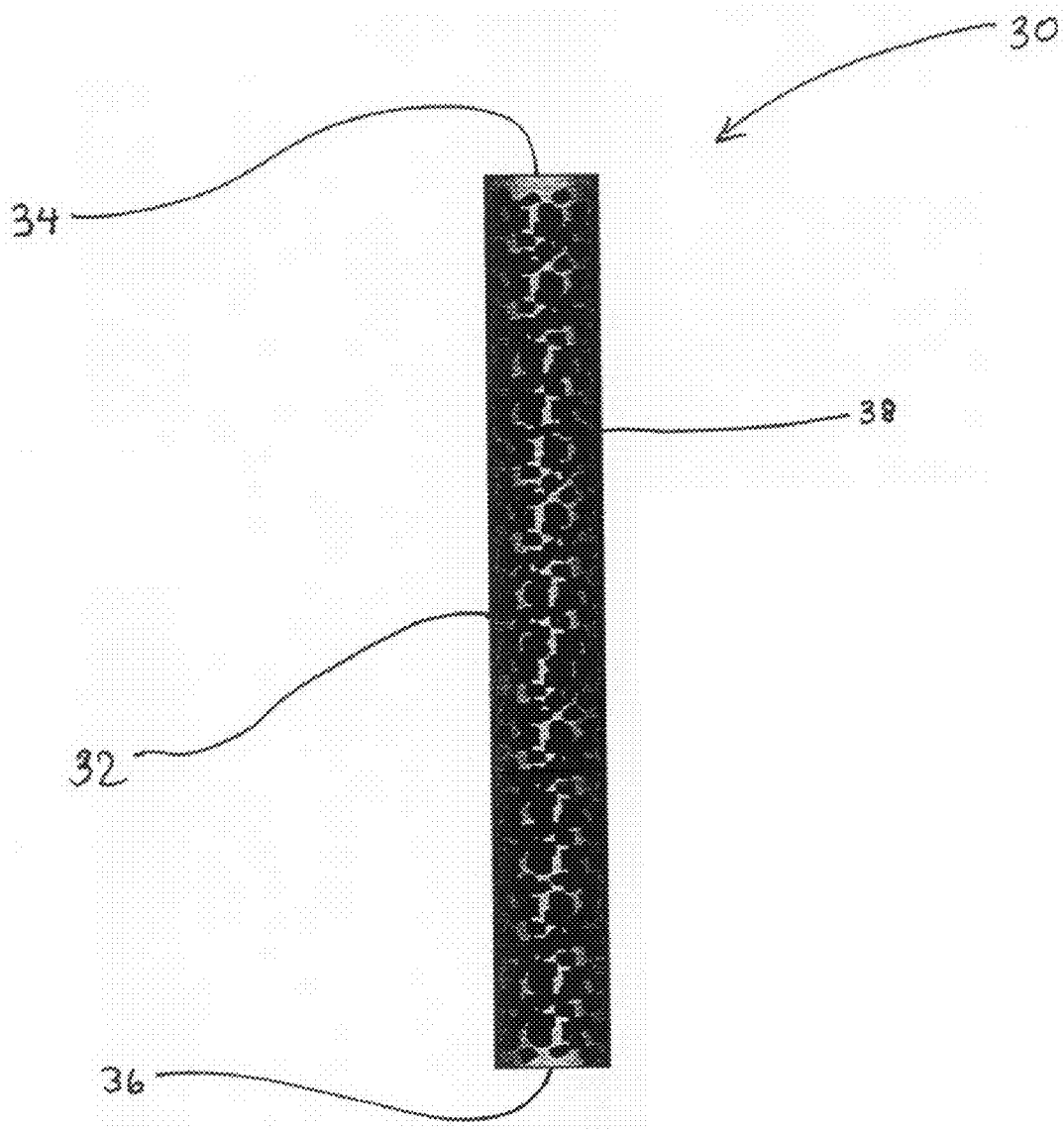
FIG. 2 shows a single pass coil with random packing.

FIG. 2 shows a single pass pyrolysis heating coil 30 with an annular portion 32, inlet 34 and an outlet 36. Here, random packing 38 is disposed in the annular portion 32.

Figure 3:
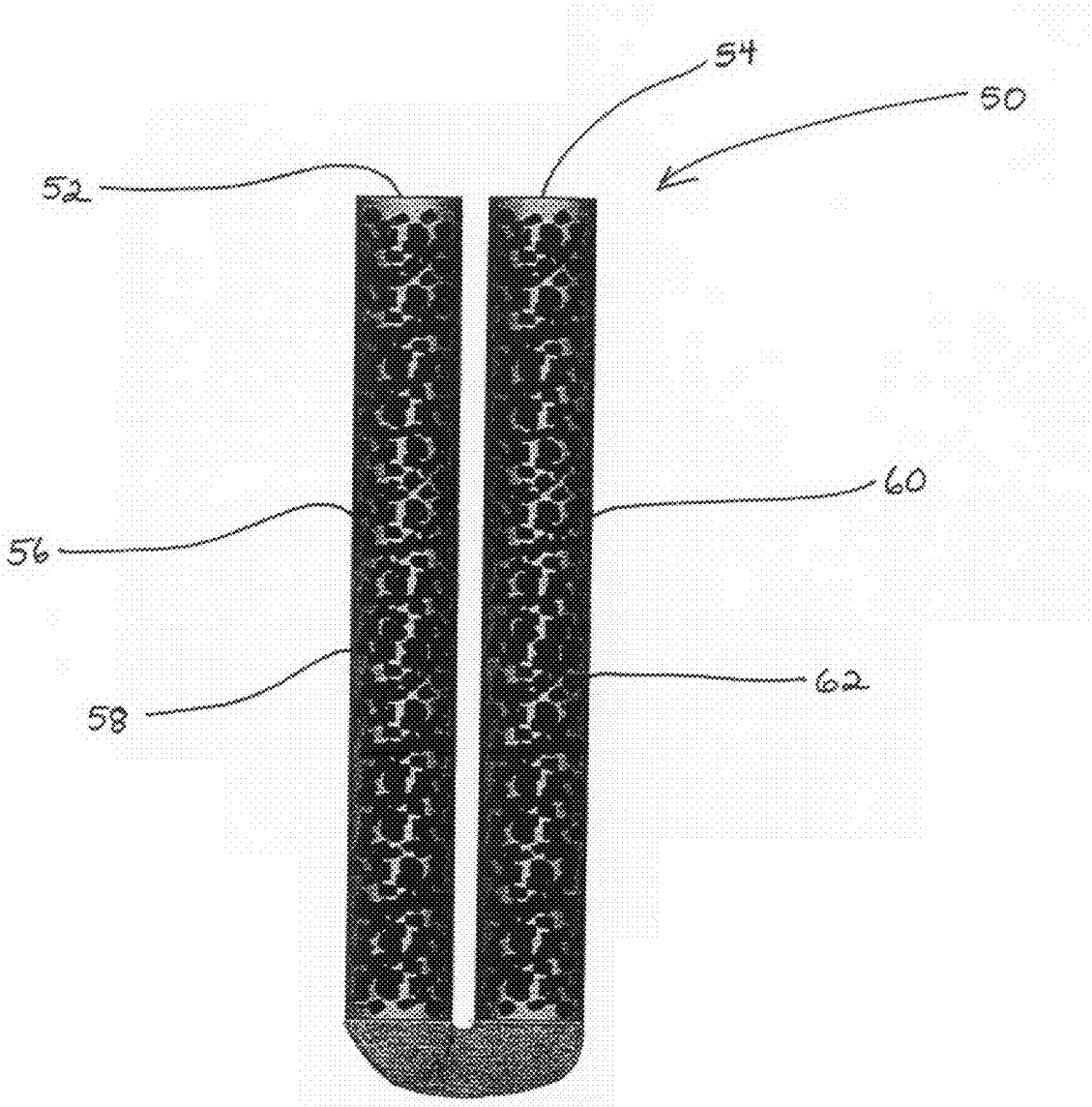
FIG. 3 shows a two-pass coil with random packing disposed in both passes.

FIG. 3 shows a two-pass pyrolysis heating coil 50 with an inlet 52 and an outlet 54. The first pass 56 comprises an annular portion containing randomly packed material 58. The second pass annular portion 60 contains additional randomly packed material 62. The material(s), 58 and 62, packed within the first and second passes, 56 and 60, can be the same or different materials. In this embodiment, the first pass has a greater diameter than the first pass of the FIG. 1 coil. Increasing the diameter of a packed coil pass prevents a substantial increase in pressure drop due to the presence of the packing. This is preferable because the rate of olefin production decreases at higher pressure drop levels. Generally, the respective void volumes of the packed and unpacked first passes are similar.

Figure 4:
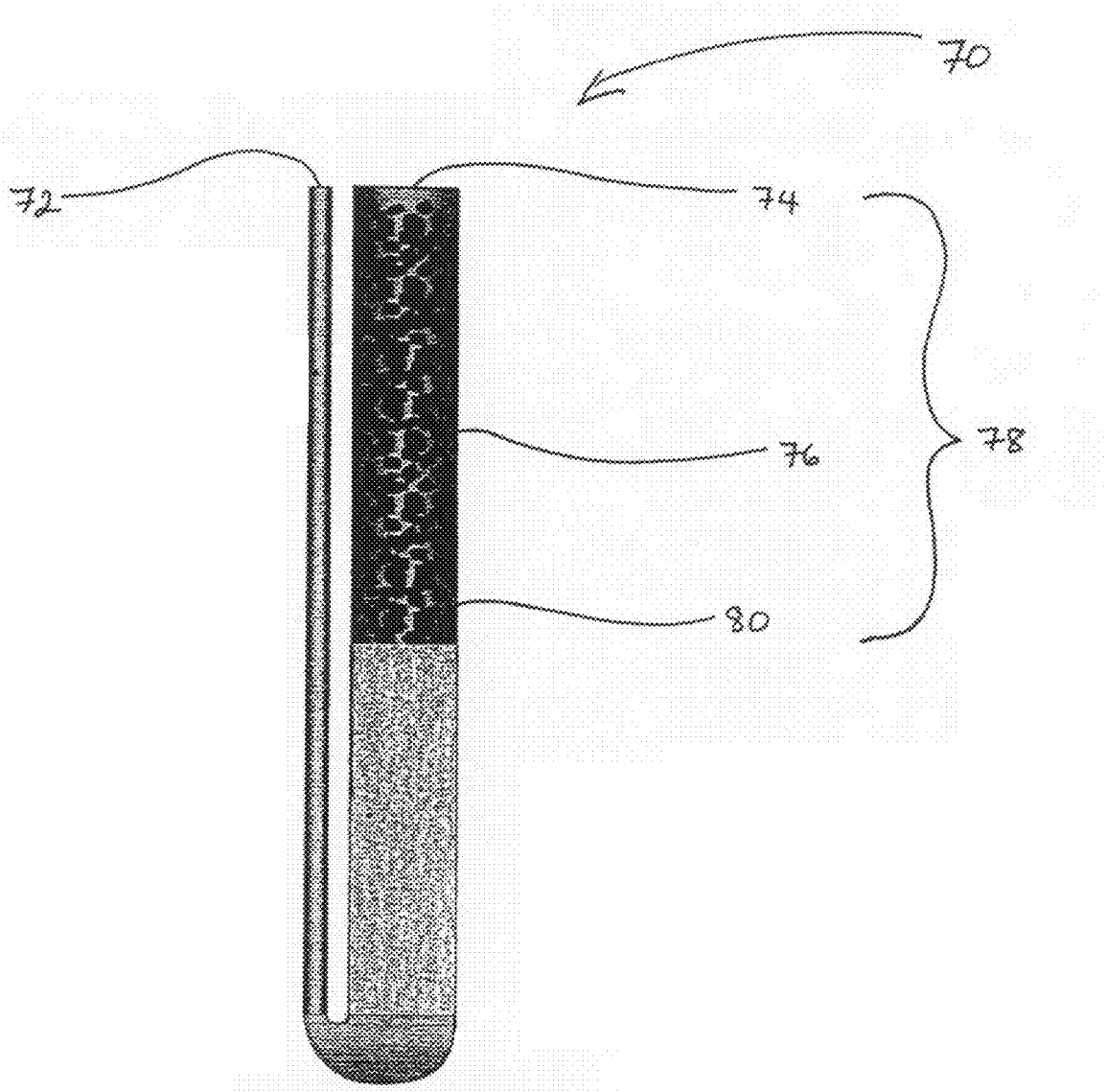
FIG. 4 shows a two-pass coil with the second pass partially packed.

It should be clear that random filler material need not be packed within the entire pass of a pyrolysis coil to achieve the benefits disclosed herein. For example, FIG. 4 depicts a two pass pyrolysis coil 70 with an inlet 72 and outlet 74. In this embodiment, filler material 76 is randomly packed within an axial portion 78 of the second pass 80. The concept of packing a portion of a pass of a pyrolysis coil is not limited to the second pass or packing only a single pass.

Figure 5:
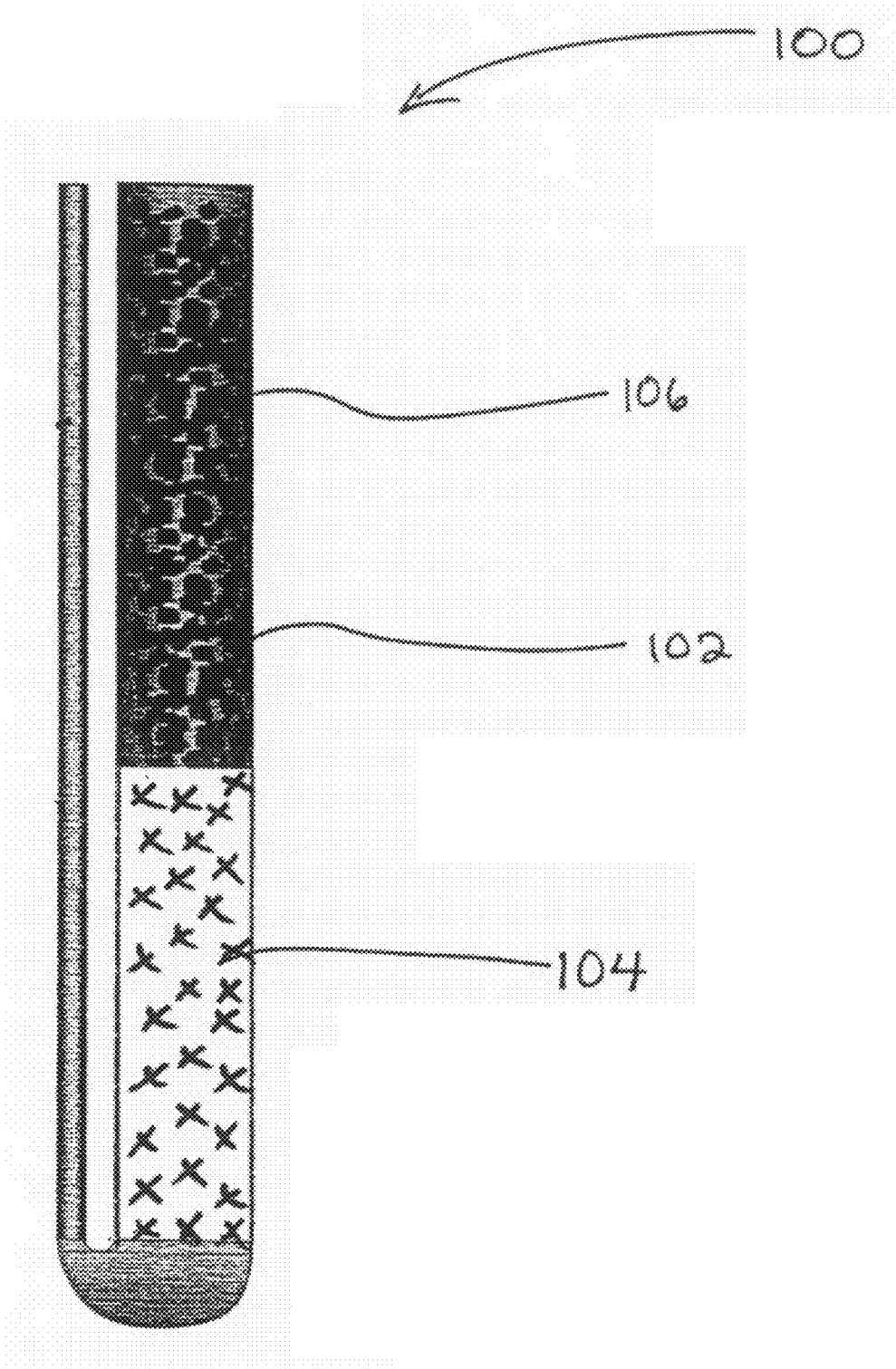
FIG. 5 shows a two-pass coil with the second pass randomly packed with two different materials.

FIG. 5 shows a two-pass pyrolysis heating coil 100 wherein the second pass 102 has an annular portion that is randomly packed with two different materials 104 and 106. In sum, it should be clear that the disclosure does not limit the relative amount or type of packing material.

A common practice for increasing heat transfer within pyrolysis coils, and therefore improving olefin production efficiency, is decreasing coil diameter. However, reducing coil diameter also yields the competing effect of increasing pressure drop, thus reducing or negating the positive effect of improved heat transfer. As discussed earlier in reference to the FIG. 3 embodiment, randomly packing coils of a larger diameter enables an increase in heat transfer coefficient without significantly increasing pressure drop.

Figure 6B:
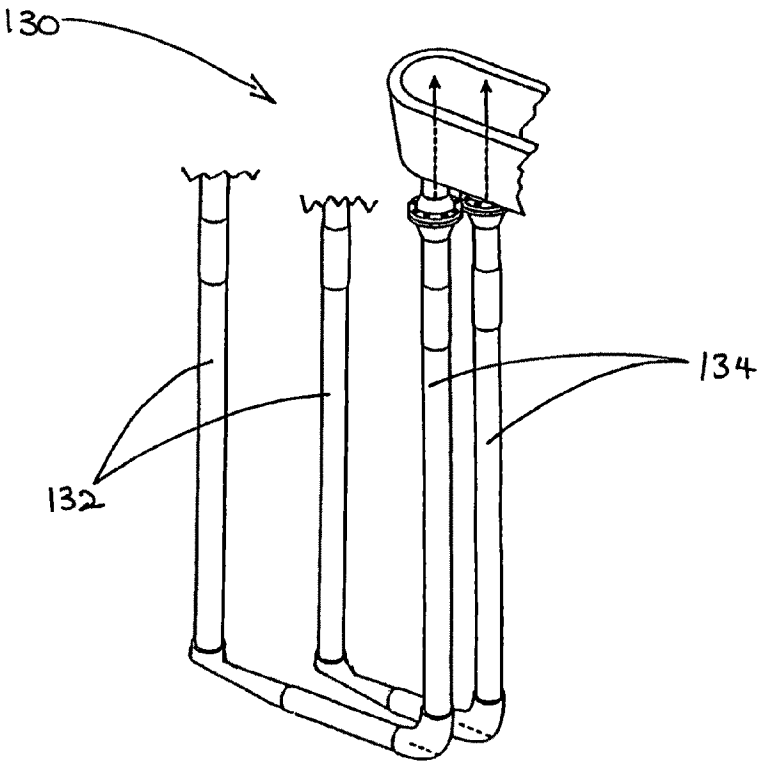
FIG. 6B shows a packed two-pass coil with one inlet pass for every outlet pass.
Figure 6A:
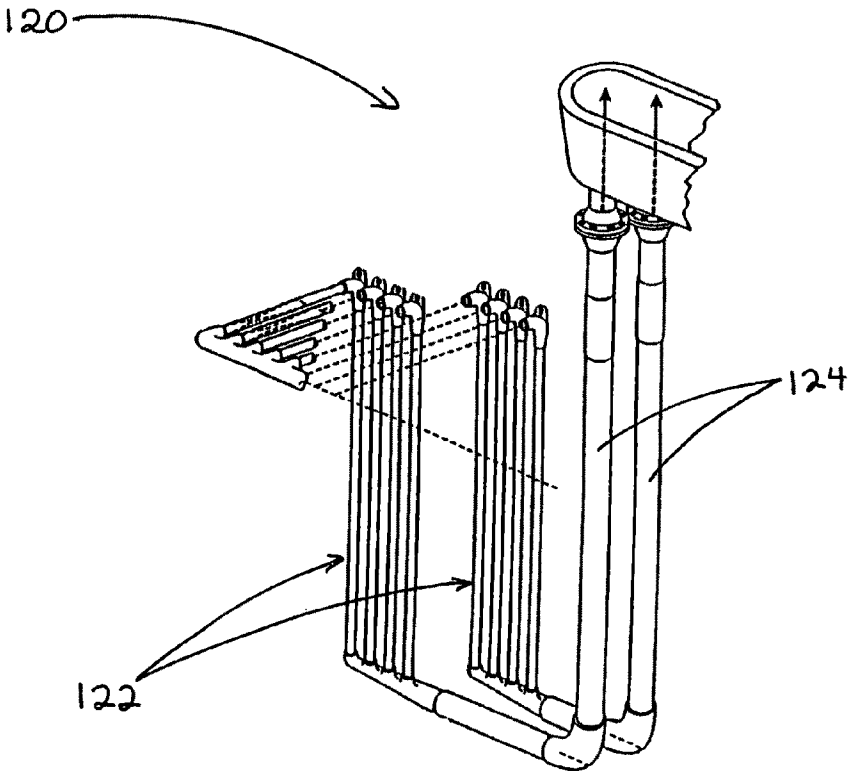
FIG. 6A shows an unpacked two-pass coil with four individual inlet passes for every outlet pass as known in the art.

FIG. 6A depicts a standard pyrolysis coil 120 as known in the art. Of note is that this particular coil features four generally parallel inlet passes 122 with relatively small diameters leading to each outlet pass 124 of a larger diameter. Such inlet passes 122 with smaller diameters are necessary to achieve sufficient heat transfer for efficient cracking in such a system.

By randomly packing at least one pass (in this case both the inlet and outlet passes; packing not shown), significantly improved heat transfer can be achieved in a coil pass having a substantially greater diameter. FIG. 6B depicts another pyrolysis coil 130 that features a single inlet pass 132 for every outlet pass 134. A single packed inlet pass of greater diameter (FIG. 6B) in conjunction with a packed outlet pass can achieve similar, if not improved, heat transfer than unpacked passes of smaller diameters (FIG. 6A) without increasing pressure drop. Consequently, the efficiency and possibly run length of the FIG. 6B coil will be improved over the FIG. 6A coil.

In all, randomly packing at least one pass of a pyrolysis coil can yield a roughly 20-100% decrease in coke production rate. Likewise, run length in a packed coil can be lengthened by approximately 20-100% as compared to an unpacked coil with similar void volume.

In all embodiments, the first and second randomly packed materials can be the same or different in size, shape and composition. Similarly, additional embodiments exist that feature coils with more than two passes. In these embodiments, random packing can be positioned in as few as one pass or as many as all of the passes. Additionally, the packing material can have virtually any shape, including, but not limited to spherical, cylindrical, rings, saddles, trilobes, quadrilobes and the like.

The aforementioned increase in heat transfer coefficient achieved by positioning random packing in a pyrolysis coil pass or passes can be seen by employing Equation 1:

$$1/h_i = 1/h_w + d_t/8k_r \qquad \text{[Equation 1]}$$

where $h_i$=heat transfer coefficient for a one-dimensional model;

$h_w$=heat transfer coefficient for a two-dimensional model;

$d_t$=tube diameter; and $k_r$=thermal conductivity of the packing material.

Equation 1 was derived in Froment, G. F. and K. B. Bischoff, "Chemical Reactor Analysis & Design", J. Wiley, NY, 1979 for predicting the equivalent heat transfer coefficient for a one-dimensional model from a two-dimensional model. Equation 1 illustrates the direct correlation between a packing material's thermal conductivity ($k_r$) and the heat transfer coefficient ($h_i$)—the overall heat transfer coefficient increases with the thermal conductivity.

Thermal conductivity values of some metals and nonmetals are shown in Table 1:

TABLE 1

| Substance | Thermal Conductivity (BTU/h · ft · ° F.) |
|---|---|
| Silicon carbide | 6.4 |
| Carborundum | 1.34 |
| Silica | 0.013 |
| Coal | 0.15 |
| Wrought iron | 42 |
| Nickel | 54 |

As can be seen, metals have superior thermal conductivities to nonmetals. However, metals significantly increase coke deposition inside the coil during operation, requiring frequent shutdowns. For this reason, silicon carbide has been shown to be one preferable packing material—it is a nonmetal with a relatively high thermal conductivity. Consequently, packing a coil with silicon carbide will exhibit a marked improvement in heat transfer coefficient while minimizing coke deposits.

In the art, several models have been developed for calculating run length from operation conditions. In all models, run length depends upon the metal temperatures at the start of the run and the end of the run. As discussed, run length decreases as maximum metal wall temperature increases.

Optimization of the geometry of the packing material can enable an even longer run length to be achieved, thus improving the overall olefin output. A higher output of olefin per unit of time can also be realized. Additionally, the packing material is often treated with a suitable catalyst. Under these conditions, olefin is produced by both thermal and catalytic cracking, thus further improving the overall cracking efficiency. In sum, randomly packing pyrolysis coils can substantially increase a system's efficiency.

The following examples are included to illustrate certain features of the invention but are not intended to be limiting.

COMPARATIVE EXAMPLE 1

A computerized simulation was conducted using a Lummus SRT VI two pass coil without random packing material. This example simulates typical running conditions employed in the field. The heat transfer coefficient was found to be 60.6 BTU/h·ft$^2$ for the first pass and 56.4 BTU/h·ft$^2$ for the second pass. Table 2 summarizes the coil parameters and operating results obtained:

TABLE 2

| | |
|---|---|
| Inlet diameter, pass 1 (in) | 2.0 |
| Outlet diameter, pass 1 (in) | 2.5 |
| No. parallel tubes, pass 1 | 16 |
| Inlet diameter, pass 2 (in) | 4.0 |
| Outlet diameter, pass 2 (in) | 4.5 |
| No. parallel tubes, pass 2 | 4 |
| Length/pass (ft) | 30 |

TABLE 2-continued

| | |
|---|---|
| Catalyst weight (kg) | 0 |
| Void fraction (—) | 1 |
| HC flow (lb/hr) | 8832 |
| Steam:oil ratio | 0.5 |
| Inlet temp (° C.) | 621.1 |
| Conversion (%) | 76.9 |
| Coil outlet temp (° C.) | 833.3 |
| Pressure drop (psi) | 1.6 |
| Max. wall temp (° C.) | 1068.9 |
| Firebox temp (° C.) | 1185 |
| Heat transfer coefficient, pass 1 (BTU/h · ft$^2$) | 60.6 |
| Heat transfer coefficient, pass 2 (BTU/h · ft$^2$) | 56.4 |
| External heat transfer area (ft$^2$) | 455.5 |

EXAMPLE 1

In this Example, a computerized simulation was conducted using a Lummus SRT VI two pass coil with random packing material in the second pass. The packing material was set to exhibit typical properties of packing materials such as silicon carbide. The heat transfer coefficient of the unpacked first pass was found to be 63.4 BTU/h·ft$^2$. The heat transfer coefficient of the packed second pass was found to be 131.1 BTU/h·ft$^2$. Table 3 summarizes the coil parameters and operating results obtained:

TABLE 3

| | |
|---|---|
| Inlet diameter, pass 1 (in) | 1.25 |
| Outlet diameter, pass 1 (in) | 1.75 |
| No. parallel tubes, pass 1 | 28 |
| Inlet diameter, pass 2 (in) | 4.0 |
| Outlet diameter, pass 2 (in) | 4.5 |
| No. parallel tubes, pass 2 | 4 |
| Length/pass (ft) | 30 |
| Catalyst weight (kg) | 1570 |
| Void fraction (—) | 0.809 |
| HC flow (lb/hr) | 8832 |
| Steam:oil ratio | 0.5 |
| Inlet temp (° C.) | 621.1 |
| Conversion (%) | 76.9 |
| Coil outlet temp (° C.) | 803.3 |
| Pressure drop (psi) | 9.2 |
| Max. wall temp (° C.) | 1031.7 |
| Firebox temp (° C.) | 1201.7 |
| Heat transfer coefficient, pass 1 (BTU/h · ft$^2$) | 63.4 |
| Heat transfer coefficient, pass 2 (BTU/h · ft$^2$) | 131.1 |
| External heat transfer area (ft$^2$) | 416.3 |

EXAMPLE 2

In this Example, a computerized simulation was conducted using a Lummus SRT VI two pass coil with random packing material in both passes. The packing material properties of this example were the same as those in Comparative Example 1. When both passes are packed, the coil diameter is increased to prevent reduced olefin yields due to a substantial pressure drop. However, due to the increase in coil diameter, significantly fewer coils are needed to treat the same capacity of feed. Packing both passes results in greater surface area within the coils than packing a single pass. Here, the heat transfer coefficient was found to be 117.1 BTU/h·ft$^2$ for the first pass and 131.8 BTU/h·ft$^2$ for the second pass. Table 4 summarizes the coil parameters and operating results obtained:

TABLE 4

| | |
|---|---|
| Inlet diameter, pass 1 (in) | 9.0 |
| Outlet diameter, pass 1 (in) | 9.8 |
| No. parallel tubes, pass 1 | 4 |
| Inlet diameter, pass 2 (in) | 9.0 |
| Outlet diameter, pass 2 (in) | 9.8 |
| No. parallel tubes, pass 2 | 4 |
| Length/pass (ft) | 30 |
| Catalyst weight (kg) | 3950 |
| Void fraction (—) | 0.809 |
| HC flow (lb/hr) | 8832 |
| Steam:oil ratio | 0.5 |
| Inlet temp (° C.) | 621.1 |
| Conversion (%) | 76.9 |
| Coil outlet temp (° C.) | 796.1 |
| Pressure drop (psi) | 7.5 |
| Max. wall temp (° C.) | 871.1 |
| Firebox temp (° C.) | 1045.6 |
| Heat transfer coefficient, pass 1 (BTU/h · $ft^2$) | 117.1 |
| Heat transfer coefficient, pass 2 (BTU/h · $ft^2$) | 131.8 |
| External heat transfer area ($ft^2$) | 590.6 |

As can be seen by comparison of Comparative Example 1 and Example 1, even with less external heat transfer area, packing the outlet tube has reduced the maximum metal wall temperature by 3.5%. This is further shown by the greater than two-fold increase in heat transfer coefficient in the packed versus unpacked second pass. Such a reduction in the maximum metal wall temperature will reduce the rate of coke production and deposit and enable longer runs prior to shutdown for decoking. Additionally, a lower maximum wall temperature could allow the use of coils made from alloys with lower melting points.

Likewise, comparison of Example 2 to Comparative Example 1 and Example 1 shows a marked increase in heat transfer coefficient in the packed first pass. Similarly, the maximum metal wall temperature in the coil with both passes packed (Example 2) is 18.5% lower than that of the unpacked coil (Comparative Example 1) and 15.6% lower than that of the single pass packed coil (Example 1). Since the rate of coke deposition increases with the maximum metal wall temperature, longer run lengths can be expected when employing random packing as in Examples 1 and 2.

As illustrated in the Tables above, outlet temperature is reduced by 3.6% when employing a packed second pass versus an unpacked coil. A coil with both passes packed yields a 4.5% reduction in outlet temperature as compared to an unpacked coil and a 0.9% reduction as compared to a two pass coil with packing in only the second pass.

As is shown by a comparison of Examples 1 and 2 with Comparative Example 1, the use of a random packing roughly doubles the heat transfer efficiency in each packed pass as compared to an unpacked coil.

In designing a packed coil, the pass diameter may be larger than that of a conventional unpacked coil used to process the same quantity of feed to compensate for the volume of the packing. The void volume in each coil should be relatively similar to ensure that the internal pressure remains relatively equal. A packed coil with increased diameter will exhibit a similar drop in pressure during operation to a non-packed coil with equivalent void volume, thereby maintaining a low partial pressure. Control of low partial pressure is conducive to high selectivity in the pyrolysis process.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A method of increasing heat transfer in a coil of a pyrolysis system with at least one generally cylindrical pass positioned between an inlet and an outlet, comprising:

replacing a portion of the at least one generally cylindrical pass with a coil section of increased diameter;

randomly packing at least part of the coil section of increased diameter with a thermally conductive ceramic filler material having a thermal conductivity ranging from about 1.34 to about 6.4 BTU/h·ft·° F.;

wherein the resulting coil including the randomly packed coil section with increased diameter is configured to exhibit a similar pressure drop during operation to that of the coil prior to the replacing and randomly packing.

2. The method of claim 1, wherein the rate of coke build-up within the packed coil during the pyrolysis process is reduced in comparison to a coil with a similar void volume without packed filler material.

3. The method of claim 1, further comprising running the pyrolysis system with at least one packed coil pass for a longer period of time than a system without random packing and a similar void volume to the coil with at least one packed pass prior to shutdown for decoking.

4. The method of claim 1, wherein the maximum temperature of the coil wall is reduced by about 2% to about 30% compared to a system without random packing and a similar void volume.

5. A method of pyrolyzing a hydrocarbon feedstock into olefins in a system having an enclosed furnace with at least one generally cylindrical coil, each coil with an inlet, an outlet and at least one pass, comprising:

randomly packing at least part of at least one coil pass with a thermally conductive ceramic filler material having a thermal conductivity ranging from about 1.34 to about 6.4 BTU/h·ft·° F., wherein the at least one coil pass is designed to exhibit a similar pressure drop during operation to a non-packed coil with equivalent void volume;

introducing the hydrocarbon feed into the inlet of the coils;

heating the coils to a temperature sufficient to break down the hydrocarbon feedstock into olefins;

collecting the olefins at the coil outlet.

6. The method of pyrolyzing a hydrocarbon feedstock of claim 5, further comprising diluting the hydrocarbon feedstock with steam.

7. The method of pyrolyzing a hydrocarbon feedstock of claim 5, wherein the randomly packed thermally conductive filler material is a catalyst that increases the rate of chemical decomposition.

8. The process for pyrolyzing a hydrocarbon feedstock of claim 5, wherein the randomly packed thermally conductive filler material is treated with a catalyst that increases the rate of chemical decomposition.

9. The process for pyrolyzing a hydrocarbon feedstock of claim 5, further comprising allowing the system with random packing in at least part of at least one pass to run for a longer period of time compared to a system without random packing and a similar void volume.

10. The process for pyrolyzing a hydrocarbon feedstock of claim 5, wherein the outlet temperature is reduced by about 0.5% to about 10% as compared to a system without random packing and a similar void volume.

* * * * *